US007063584B2

(12) United States Patent
Yonehara et al.

(10) Patent No.: US 7,063,584 B2
(45) Date of Patent: Jun. 20, 2006

(54) METHOD OF MANUFACTURING GAS DISCHARGE DISPLAY PANEL, SUPPORT TABLE, AND METHOD OF MANUFACTURING SUPPORT TABLE

(75) Inventors: Hiroyuki Yonehara, Hirakata (JP); Masaki Aoki, Minoo (JP); Keisuke Sumida, Hirakata (JP); Morio Fujitani, Takatsuki (JP); Hideki Asida, Settsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 228 days.

(21) Appl. No.: 10/478,890

(22) PCT Filed: May 28, 2002

(86) PCT No.: PCT/JP02/05140

§ 371 (c)(1),
(2), (4) Date: Jun. 7, 2004

(87) PCT Pub. No.: WO02/101780

PCT Pub. Date: Dec. 19, 2002

(65) Prior Publication Data

US 2004/0219858 A1 Nov. 4, 2004

(30) Foreign Application Priority Data

May 30, 2001 (JP) ..... 2001-162227

(51) Int. Cl.
*H01J 9/00* (2006.01)

(52) U.S. Cl. ..... 445/23

(58) Field of Classification Search ..... 445/23–25; 156/345.55, 345.11, 345.23, 345.12
See application file for complete search history.

(56) References Cited

FOREIGN PATENT DOCUMENTS

| | | |
|---|---|---|
| JP | 4028995 | 1/1992 |
| JP | 8189774 | 7/1996 |
| JP | 8208254 | 8/1996 |
| JP | 9020527 | 1/1997 |
| JP | 9119779 | 5/1997 |
| JP | 11108559 | 4/1999 |
| JP | 2000128346 | 5/2000 |
| JP | 200304458 | 11/2000 |
| JP | 2001012862 | 1/2001 |
| JP | 2002090067 | 3/2002 |

*Primary Examiner*—Joseph Williams

(57) ABSTRACT

A manufacturing method for a gas discharge display panel includes a disposing step of disposing on a substrate, material of one of an electrode, a dielectric layer, a barrier rib, and a phosphor layer; and a baking step of baking the substrate on which the material has been disposed, while the substrate is carried on a support platform. The support platform has at least one channel in a surface thereof on which the substrate is placed, extending from a covered area covered by the substrate through to an exposed area not covered by the substrate.

34 Claims, 11 Drawing Sheets

210
201

221
220
211
212

229
230
251
211

251
250

METHOD OF MANUFACTURING GAS DISCHARGE DISPLAY PANEL, SUPPORT TABLE, AND METHOD OF MANUFACTURING SUPPORT TABLE

Method for manufacturing gas discharge display panel, support platform, and method for manufacturing the support platform

TECHNICAL FIELD

The present invention relates a method for manufacturing a gas discharge display panel used in a display device or the like, and in particular to a method for supporting a glass substrate of the gas discharge display panel in a baking process for forming electrodes, a dielectric layer or the like on the glass substrate

BACKGROUND ART

In recent years gas discharge display panels such as plasma display panels (PDPs) have been attracting interest as display apparatuses for use in computers, television and the like due to their suitability as thin, light large-screen display devices.

FIG. 1 is a schematic diagram of a common alternating current (AC) PDP.

As the diagram shows, a PDP 100 is composed of a front plate 90 and a back plate 91 that are arranged with their main surfaces facing each other.

The front plate 90 is made up of a front glass substrate 101, display electrodes 102, a dielectric layer 106, and a protective layer 107.

The front glass substrate 101 is the material that is the base of the front plate 90, and the display electrodes 102 are formed on this front glass substrate 101.

Each display electrode 102 includes a transparent electrode 103, a black electrode film 104, and a bus electrode 105.

The display electrodes 102 and the front glass substrate 101 are further covered with the dielectric layer 106 and the protective layer 107.

The back panel 91 includes a back panel substrate 111, address electrodes 112, a dielectric layer 113, barrier ribs 114, and phosphor layers 115 formed in the gaps between neighboring barrier ribs 114. Hereinafter these gaps are referred to as barrier rib channels.

The front plate 90 and the back plate 91 are placed together and sealed as shown in FIG. 1, thus forming discharge spaces 116 inside.

Note that in the present drawing the end of the back plate 91 is illustrated as being open for convenience in explaining the structure. In reality the periphery is sealed closed.

Discharge gas (enclosed gas) made up of a rare gas component such as He, Xe or Ne is enclosed in the discharge space 116 at a pressure of approximately 500 Torr to 600 Torr (66.5 kPa to 79.8 kPa).

Areas where a pair of neighboring display electrodes 102 and one address electrode 112 intersect surrounding a discharge space 116 are cells that contribute to image display.

FIG. 2 shows the structure of a plasma display apparatus that is one type of gas discharge display apparatus.

This plasma display apparatus is composed of a PDP 100 and a panel driving device 119.

In this plasma display apparatus, address discharge is performed by applying voltage across the X electrode and the address electrode 112 of the cell that is to be illuminated, and then sustain discharge is performed by applying a pulse voltage to the pair of neighboring display electrodes 102.

In the PDP 100, this sustain discharge generates ultraviolet light in the discharge cell 116. The ultraviolet light hits the phosphor layer 115 and is converted to visible light, resulting in the cell being illuminated. This is how an image is displayed.

The front glass substrate 101 is subject to baking in the process for forming the black electrode film 104 and the bus electrode 105 and the process for forming the dielectric layer 106.

Furthermore, in the processes for forming the address electrodes 112, the dielectric layer 113, the barrier ribs 114, and the phosphor layer 115, the back glass substrate 111, on which these materials have been applied, is subject to baking.

In the baking processes, each of the front glass substrate 101 and the back glass substrate 111 (hereinafter "glass substrate" refers to either one), on which the black electrode film 104, the dielectric layer 113, or another of the materials to be baked has been disposed, is placed on a setter 120 and baked. The setter 120 is a heat resistant material that is in the shape of a plate that is larger than the size of the glass substrates.

The setter 200, on which the glass substrate has been placed, is carried through a continuous baking oven by hearth rollers 130, and baked at a temperature profile in which the peak temperature is set at, for example, 590° C.

However, the following problems occur during the heating process.

As shown in FIG. 4, the front glass plate 101 or the back glass plate 111 is placed in the correct position while at room temperature, but moves from the correct position (hereinafter call "misalignment") during baking. This gives rise to the problem that the material that is baked, such as the dielectric layer, on the front glass plate 101 or the back glass plate 111 is not baked at an even temperature, and unevenness of temperature distribution occurs.

Misalignment tends to happen more frequently the larger the size of the front glass substrate 101 and the back glass substrate 111.

There are cases in which the normal characteristics of the materials cannot be obtained when baking is imperfect due to the materials not being baked at an even temperature.

For example, when baking of the dielectric layer 106 is imperfect, organic compounds such as resin are insufficiently removed and remain in the dielectric layer, thus making it difficult to ensure normal transparency and insulation characteristics.

Furthermore, when baking of the barrier ribs 114 is imperfect, the barrier ribs 114 lack strength, and may exhibit cracking or the like. In addition, the surfaces of imperfectly baked barrier ribs 114 have are uneven, and consequently prevent the phosphor layer 115 from being applied with even film thickness to the surfaces of the barrier ribs 114 in a later process.

In other words, problems in the quality of the gas discharge display panels can occur due to the baking processes.

DISCLOSURE OF THE INVENTION

In view of the stated problems, the object of the present invention is to provide a gas discharge display panel manufacturing method that reduces problems of inferior quality in the gas discharge display panel caused by the baking process, a setter that reduces problems of inferior quality caused by the baking process, and a method for manufacturing the setter.

In order to achieve the stated object, the present invention is a manufacturing method for a gas discharge display panel, including: a disposing step of disposing on a substrate, material of one of an electrode, a dielectric layer, a barrier rib, and a phosphor layer; and a baking step of baking the substrate on which the material has been disposed, while the substrate is carried on a support platform, wherein the support platform has at least one channel in a surface thereof on which the substrate is placed, extending from a covered area covered by the substrate through to an exposed area not covered by the substrate.

Accordingly, gas in the channels can freely move between the covered area and the exposed area.

Specifically, although the substrate becomes buoyant when the pressure of the gas in the spaces between the substrate and the support platform increases, the present manufacturing method reduces increases in pressure in the spaces because the gas around the channels in the covered area escapes. Therefore, buoyancy is reduced.

Accordingly, misalignment during baking is suppressed, and unevenness of temperature distribution and the like occur less easily. This improves the problem of quality in baking.

Furthermore, a plurality of the channels may be provided in the surface, distributed throughout the covered area.

Accordingly, the areas that reduce buoyancy are distributed, and therefore buoyancy is reduced efficiently.

Furthermore, a continuous baking oven may be used for the baking, and the plurality of channels may be positioned substantially perpendicular to a direction in which the substrate is carried into the baking oven.

Accordingly, when heating commences from a front end in a direction in which the support platform is carried, and the temperature increases, temperature and pressure gradients occur less frequently in the channels because the channels are provided in a direction perpendicular to the carrying direction.

For this reason, localized buoyancy in one of the channels is prevented from occurring, and the floating of the substrate is suppressed.

Furthermore, a continuous baking oven may be used for the baking, and the plurality of channels may be positioned substantially parallel to a direction in which the substrate is carried into the baking oven.

Accordingly, when heating commences from a front end in a direction in which the support platform is carried and gas moves toward the back end. Therefore heat is conducted in a longitudinal direction of the channels.

In other words, when the support platform is carried at low speed, thermal conductivity in the carry direction of the substrate and the support platform is more important than thermal conductivity between the substrate and the support platform (between the top and the bottom). Therefore, by providing a plurality of channels that are substantially parallel to the carry direction and extend at least across the area on which the substrate is placed on the support platform, heat is conducted to the back end by the gas escaping to the back end, even if the support platform is heated from the front end. Therefore, temperature gradients in the carry direction and unevenness of temperature distribution is suppressed.

Furthermore, the plurality of channels may be positioned substantially symmetrically relative to a center point or a center line of the covered area.

Accordingly, the channels can be easily positioned evenly.

Specifically, if gas in the spaces between the substrate and the support platform increases in pressure, the gas is able to escape through the channels that are provided substantially symmetrically relative to the center point or the center line of the covered area. Therefore, the areas that reduce pressure in the spaces are distributed throughout the surface of the substrate. As a result, pressure is prevented from increasing locally, and misalignment of the substrate can be suppressed easily.

Furthermore, a non-contact area, which is a part of the covered area and is where the substrate and the support platform do not contact each other, may have a surface area that is equal to at least 10% and no more than 70% of a surface area of the substrate.

Accordingly, the substrate is prevented from floating and is held securely.

Furthermore, the support platform may be made of a material whose main component is glass.

Accordingly, the influence of radiation that lowers thermal conductivity performance of the channels is reduced because the glass material accelerates thermal conductivity between the substrate and the support platform according to radiation.

Furthermore, each channel may be at least 0.05 mm and no more than 2.0 mm deep, and at least 5 mm and no more than 200 mm wide.

Accordingly, thermal conductivity performance between the substrate and the support platform is maintained.

Specifically, thermal conductivity performance between the substrate and the support platform is maintained at a level at which baking does not cause inferior quality.

Furthermore, a gas discharge display panel manufacturing method of the present invention includes: a disposing step of disposing on a substrate, material of one of an electrode, a dielectric layer, a barrier rib, and a phosphor layer; and a baking step of baking the substrate on which the material has been disposed, while the substrate is carried on a support platform, wherein the support platform has a plurality of holes extending from a top surface on which the substrate is placed through to a bottom surface.

Accordingly, gas in the gaps between the substrate and the support platform is able to move freely through the holes to a back surface of the support platform.

Specifically, when the pressure of the gas in the gaps between the substrate and the support platform increases, the substrate floats and becomes misaligned. However, according to the stated manufacturing method, the gas on the top surface is able to escape through the holes to the bottom surface. Therefore, increase in pressure in the gaps is reduced, and buoyancy is reduced.

Accordingly, misalignment during baking is suppressed, and unevenness of temperature distribution and the like occur less easily. This improves the problem of quality in baking.

Furthermore, the support platform of the present invention is for carrying a substrate in a process for baking material disposed on the substrate, the substrate being used in a gas discharge display panel, wherein at least one channel is provided in a surface of the support platform on which the substrate is carried, each channel extending from a covered area covered by the substrate through to an exposed area not covered by the substrate.

The gas in the channels is able to move freely between the covered area and the exposed area of the substrate on which the material has been disposed is baked placed on the support platform.

Specifically, although the substrate becomes buoyant when the pressure of the gas in the spaces between the substrate and the support platform increases, the present manufacturing method reduces increases in pressure in the spaces because the gas around the channels in the covered area escapes. Therefore, buoyancy is reduced.

Accordingly, misalignment during baking is suppressed, and unevenness of temperature distribution and the like occur less easily. This improves the problem of quality in baking.

Furthermore, a plurality of the channels may be provided in the surface, distributed throughout the covered area.

When the substrate on which the material has been disposed is baked placed on the support platform, buoyancy is reduced efficiently because the areas that reduce buoyancy are distributed.

Furthermore, a continuous baking oven may be used for the baking, and the plurality of channels may be positioned substantially perpendicular to a direction in which the substrate is carried into the baking oven.

If the substrate on which the material has been disposed is baked placed on the support platform, when heating commences from a front end in a direction in which the support platform is carried, and the temperature increases, temperature and pressure gradients occur less frequently in the channels because the channels are provided in a direction perpendicular to the carrying direction.

For this reason, localized buoyancy in one of the channels is prevented from occurring, and the floating of the substrate is suppressed.

Furthermore, a continuous baking oven may be used for the baking, and the plurality of channels may be positioned substantially parallel to a direction in which the substrate is carried into the baking oven.

If the substrate on which the material has been disposed is baked placed on the support platform, when heating commences from a front end in a direction in which the support platform is carried and gas moves toward the back end. Therefore heat is conducted in a longitudinal direction of the channels.

In other words, when the support platform is carried at low speed, thermal conductivity in the carry direction of the substrate and the support platform is more important than thermal conductivity between the substrate and the support platform (between the top and the bottom). Therefore, by providing a plurality of channels that are substantially parallel to the carry direction and extend at least across the area on which the substrate is placed on the support platform, heat is conducted to the back end by the gas escaping to the back end, even if the support platform is heated from the front end. Therefore, a temperature gradient in the carry direction and unevenness of temperature distribution are suppressed.

Furthermore, the plurality of channels may be positioned substantially symmetrically relative to a center point or a center line of the covered area.

When the substrate on which the material has been disposed is baked placed on the support platform, the channels can be easily positioned evenly.

Specifically, if gas in the spaces between the substrate and the support platform increases in pressure, the gas is able to escape through the channels that are provided substantially symmetrically with respect to the center point or the center line of the covered area. Therefore, the areas that reduce pressure in the spaces are distributed throughout the surface of the substrate. As a result, pressure is prevented from increasing locally, and misalignment of the substrate can be suppressed easily.

Furthermore, a non-contact area, which is a part of the covered area and is where the substrate and the support platform do not contact each other, may have a surface area that is equal to at least 10% and no more than 70% of a surface area of the substrate.

If the substrate on which the material has been disposed is baked placed on the support platform, the substrate is prevented from floating and is held securely.

Furthermore, the support platform may be made of a material whose main component is glass.

If the substrate on which the material has been disposed is baked placed on the support platform, the influence of radiation that reduces thermal conductivity performance of the channels is reduced because thermal conductivity between the substrate and the support platform according to radiation is accelerated.

Furthermore, each channel may be at least 0.05 mm and no more than 2.0 mm deep, and at least 5 mm and no more than 200 mm wide.

If the substrate on which the material has been disposed is baked placed on the support platform, thermal conductivity performance between the substrate and the support platform is maintained.

Specifically, thermal conductivity performance between the substrate and the support platform is maintained at a level at which baking does not cause inferior quality.

Furthermore, the present invention is a support platform for carrying a substrate in a process for baking material disposed on the substrate, the substrate being used in a gas discharge display panel, wherein the support platform has a plurality of holes extending from a top surface on which the substrate is placed through to a bottom surface.

If the substrate on which the material has been disposed is baked placed on the support platform, the gas escapes from the side of the support platform on which the substrate is placed through the holes to the other side of the substrate.

Furthermore, the support platform manufacturing method of the present invention is a manufacturing method for a support platform for carrying a substrate in a process for baking material disposed on the substrate, the substrate being used in a gas discharge display panel, the manufacturing method including: a channel forming step of forming at least one channel in a surface of plate that is used in the support platform, the channel extending from a covered area that is covered by the substrate when the substrate is placed on the support platform, through to an exposed area that is not covered by the substrate when the substrate is placed on the support platform.

Accordingly, if the substrate on which the material has been disposed is baked placed on the support platform manufactured according to the stated method, gas in the channels is able to move freely from the covered area to the exposed area.

Specifically, when the pressure of the gas in the gaps between the substrate and the support platform increases, the substrate floats and becomes misaligned. However, according to the stated manufacturing method, the gas around the channel is able to escape through the channel. Therefore, increase in pressure in the gaps is reduced, and buoyancy is reduced.

Accordingly, misalignment during baking is suppressed, and unevenness of temperature distribution and the like occur less easily. This improves the problem of quality in baking.

Furthermore, a non-contact area, which is a part of the covered area and is where the substrate and the support platform do not contact each other, may have a surface area that is equal to at least 10% and no more than 70% of a surface area of the substrate.

If the substrate on which the material has been disposed is baked placed on the support platform, buoyancy is reduced and the substrate is held securely.

Furthermore, in the channel forming step, the channel may be formed by removing part of the surface by sandblasting.

According to the stated method, when the non-contact area is relatively small, the channel can be formed easily using sandblasting.

Furthermore, in the channel forming step, the channel may be formed dissolving part of the surface by chemical etching.

According to the stated method, when the non-contact area is relatively small, the channel can be formed easily using chemical etching.

Furthermore, in the channel forming step, the channel may be formed by providing protrusions on the surface excluding an areas where the channel is to be provided, using thermal spraying.

According to the stated method, when the non-contact area is relatively large, the channel can be formed easily using thermal spraying.

Furthermore, the support platform manufacturing method of the present invention is a manufacturing method for a support platform for carrying a substrate in a process for baking material disposed on the substrate, the substrate being part of a gas discharge display panel, the manufacturing method including: a hole forming step of forming a plurality of holes in a plate that is part of the support platform, the holes extending from a top surface of the plate that is covered by the substrate when the substrate is placed on the plate, through to a bottom surface.

If a substrate is baked on a support platform made according to the support platform manufacturing method of the present embodiment, gas in the spaces between the substrate and the support platform is able to move freely through the holes to the back side of the support platform.

Specifically, although the substrate becomes buoyant when the pressure of the gas in the spaces between the substrate and the support platform increases, the present manufacturing method reduces increases in pressure in the spaces because gas from the top surface of the support platform that is covered by the substrate is discharged through the holes to back. Therefore, buoyancy is reduced.

Accordingly, misalignment during baking is suppressed, and unevenness of temperature distribution and the like occur less easily. This improves the problem of quality in baking.

BEST MODE FOR CARRYING OUT THE INVENTION

Preferred Embodiment

<Structure>

The PDP of the preferred embodiment of the present invention is baked in the baking process using a setter 200 (described later), and has the same structure as the general PDP 100.

Consequently, the PDP 100 shown in FIG. 1 will be described as the PDP of the embodiment of the present invention.

Figure 1:
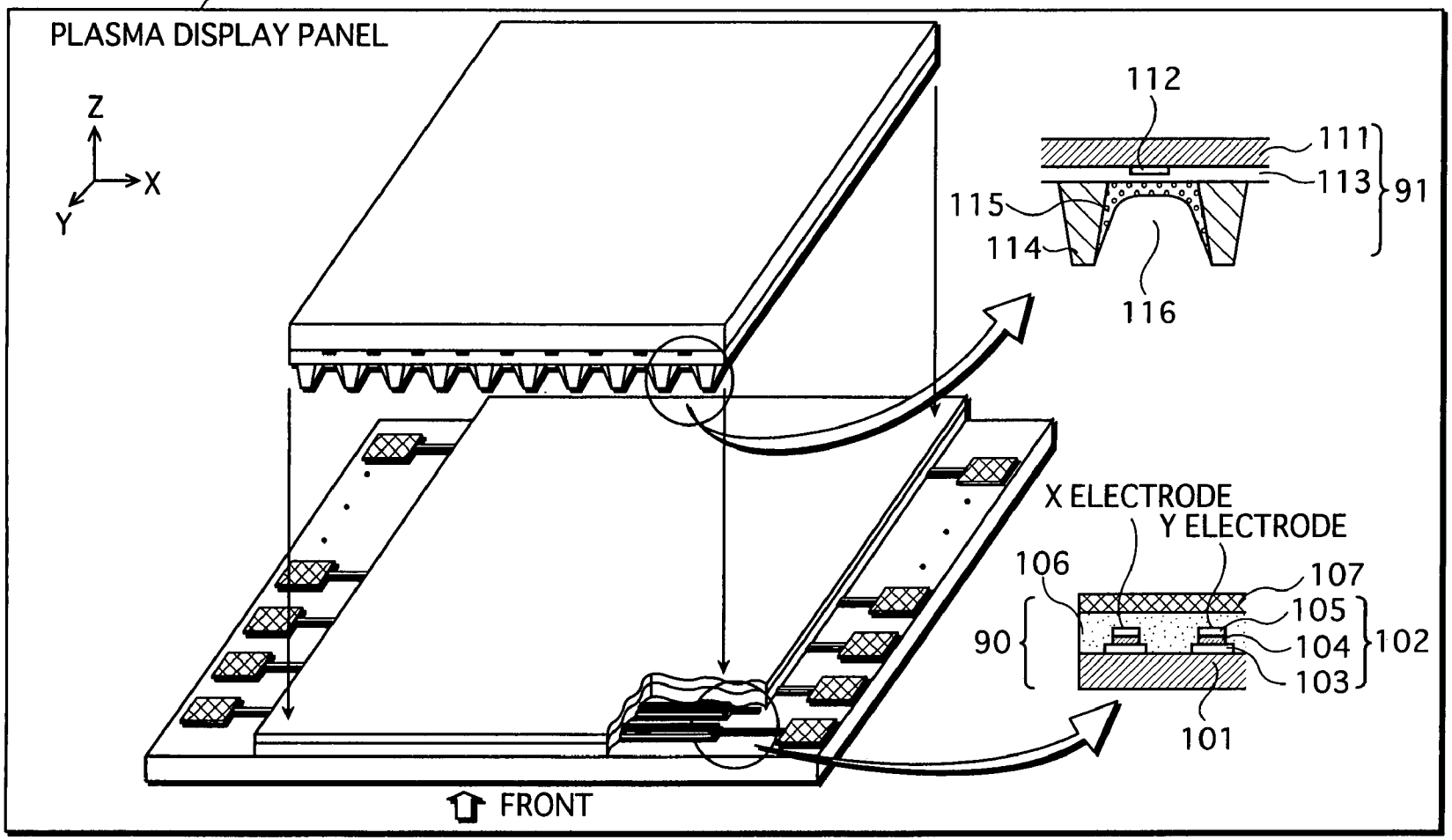
FIG. 1 is a schematic drawing showing one example of a general alternating current (AC) PDP.

As shown in FIG. 1, the PDP 100 of the embodiment of the present invention is composed of the front plate 90 and the back plate 91 arranged with their respective main surfaces facing each other.

In the drawing, the z direction corresponds to the thickness direction of the PDP, while the xy plane corresponds to a plane that is parallel to the surface of the PDP.

The front plate 90 is composed of the front glass substrate 101, the display electrodes 102, the dielectric layer 106, and the protective layer 107.

The front glass substrate 101 is the material that is the base of the front plate 90, and the display electrodes 102 are formed thereon.

Each display electrode 102 is composed of a transparent electrode 103, a black electrode film 104, and a bus electrode 105.

The transparent electrodes 103 are formed in lines on one surface of the front glass substrate 101 from a conductive metal oxide such as ITO, $SnO_2$, or ZnO. The longitudinal direction of the transparent electrodes 103 is the x direction.

The black electrode layers 104 are formed by layering a material whose main component is ruthenium oxide on the transparent electrodes 103. The black electrode layers 104 are narrower than the transparent electrodes 103.

The bus electrodes 105 are formed by layering a conductive material that includes Ag on the black electrode layers 104.

The dielectric layer 106 is formed from a dielectric material that covers the surface of the front glass substrate 101 on which the display electrodes 102 have been formed. Generally a lead glass with a low melting point is used for the dielectric layer 106, but the dielectric layer 106 may be formed from a bismuth glass with a low melting point, or by layering a lead glass with a low melting point and a bismuth glass with a low melting point.

The protective layer 107 is a thin layer of magnesium oxide (MgO), and covers the whole surface of the dielectric layer 106.

The back plate 91 is composed of the back glass plate 111, the address electrodes 112, the dielectric layer 113, the barrier ribs 114, and the phosphor layers 115 that are laminated on the walls of the channels that are formed due to the gaps between neighboring barrier ribs 114.

The back glass substrate 111 is the material that is the base of the back plate 91, and the address electrodes 112 are formed thereon.

The address electrodes 112 are metal electrodes (for example, silver electrodes or Cr—Cu—Cr electrodes) that are formed in lines on one surface of the back glass substrate 111 from conductive material that includes Ag. The longitudinal direction of the address electrodes 112 is the y direction.

The dielectric layer 113 is formed from a dielectric material that covers the surface of the back glass substrate 111 on which the address electrodes 112 have been formed. Generally a lead glass with a low melting point is used for the dielectric layer 113, the dielectric layer 113 may be formed from a bismuth glass that has a low melting point, or by layering a lead glass that has a low melting point and bismuth glass that has a low melting point.

Furthermore, the barrier ribs 114 are formed on the dielectric layer 113 in positions corresponding to gaps between neighboring address electrodes 112.

The phosphor layers 115 are then formed on the wall surfaces of the channels that are formed due to the gaps between neighboring barrier ribs 114. Each phosphor layer 115 corresponds to either red (R), green (G) or blue (B).

More specifically, there are three types of phosphor layer 115 that emit light of mutually differing wave lengths that correspond to red, green, and blue, respectively. The red, green, and blue phosphor is applied successively in the stated order to the walls of the channels.

The front plate 90 and the back plate 91 are sealed together as shown in FIG. 1, thereby forming an internal discharge space 116.

Discharge gas (enclosed gas) having a rare gas component such as He, Xe or Ne is enclosed in the discharge space 116 at a pressure of approximately 500 Torr to 600 Torr (66.5 kPa to 79.8 kPa).

Each areas where a pair of neighboring display electrodes 102 cross with one address electrode 112 thereby surrounding part of the discharge space 116 are cells that contribute to image display.

Figure 2:
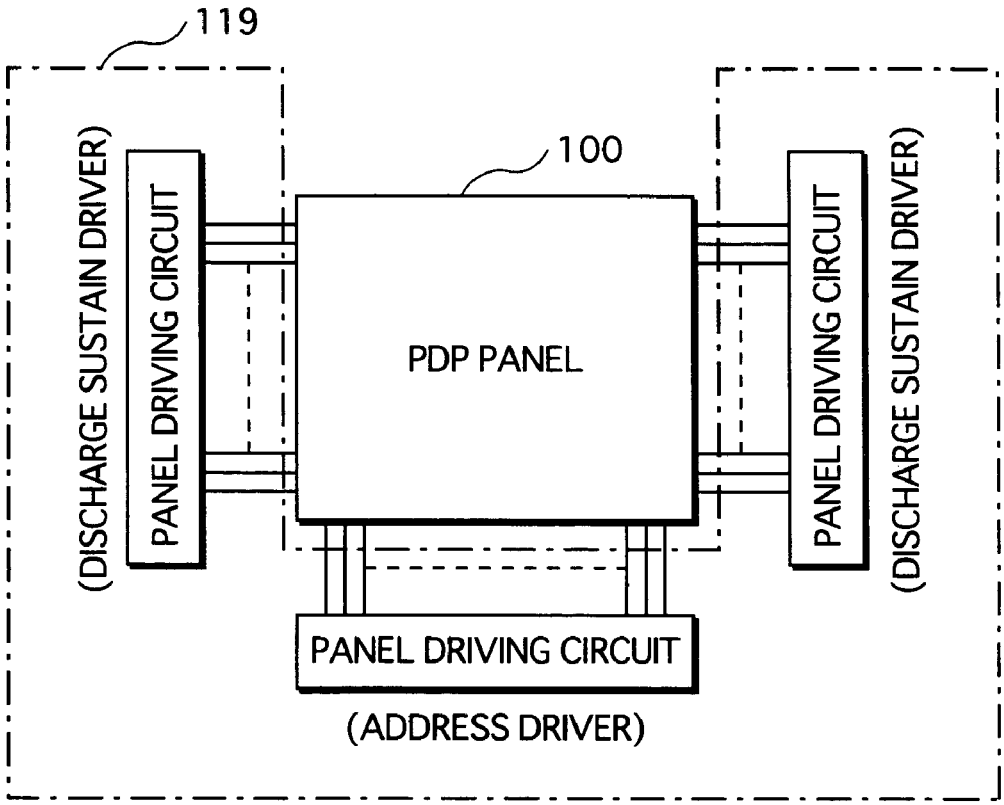
FIG. 2 shows the structure of a plasma display apparatus.
Figure 3:
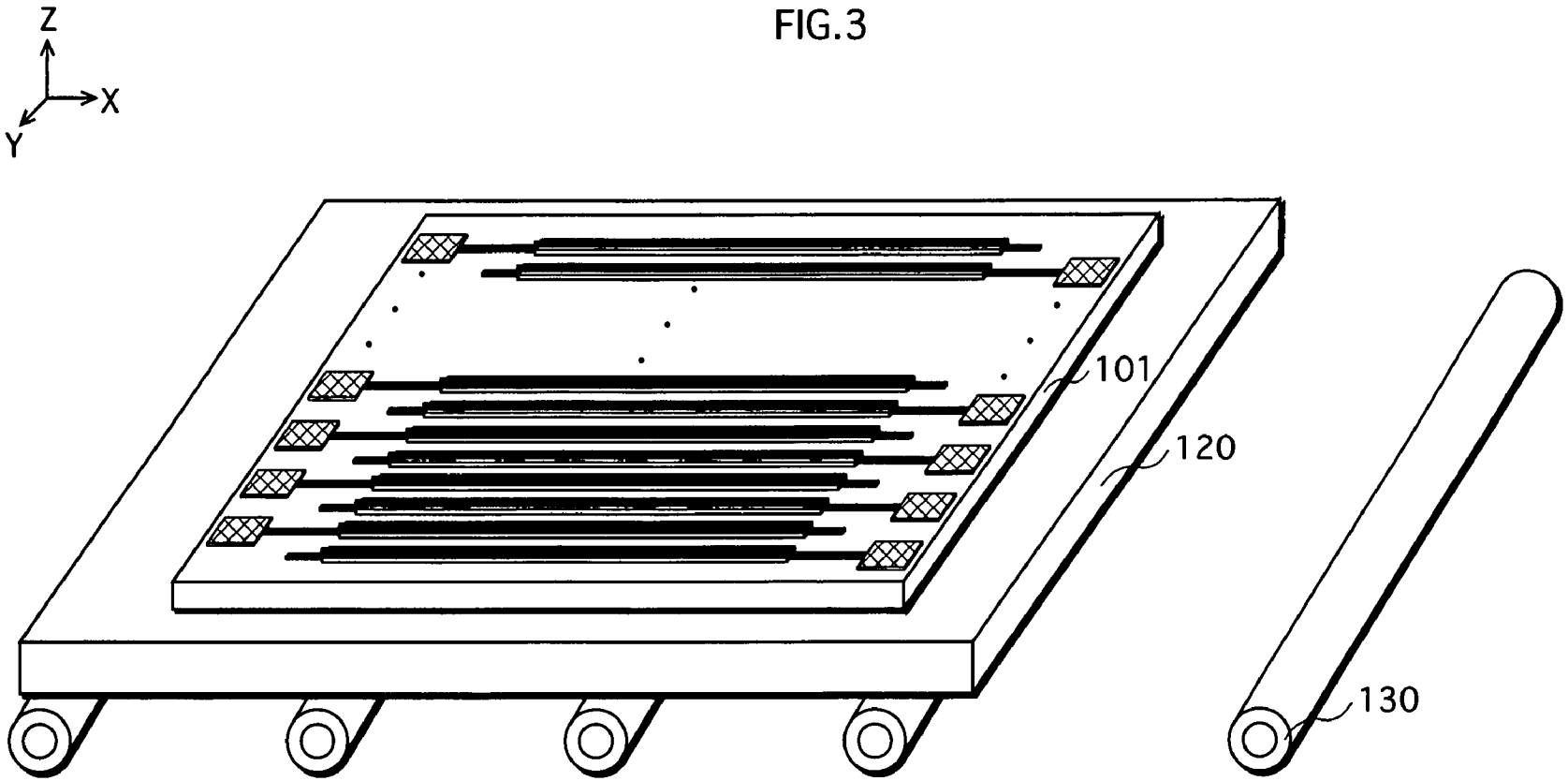
FIG. 3 shows the state of a glass substrate and a setter during a baking process.

As shown in FIG. 2, the plasma display apparatus 220 is composed of the PDP 100 and the panel driving device 119. In this plasma display apparatus, address discharge is performed by applying voltage across the X electrode and the address electrode 112 of the cell that is to be illuminated, and then sustain discharge is performed by applying a pulse voltage to the pair of neighboring display electrodes 102.

Sustain discharge generates ultraviolet light (wave length approximately 147 nm), which hits the phosphor layer 115 and is thereby converted to visible light, resulting in the cell being illuminated. This is how an image is displayed.

<PDP Manufacturing Method>

The PDP 100 is made by sealing the front plate 90 and the back plate 91 together as described above, and then inserting discharge gas.

The following describes the method of manufacturing the front plate 90.

In the method for manufacturing the gas discharge display panel of the present invention, the transparent electrodes 103 are formed using the commonly-known technique such as evaporation or sputtering. Here, a conductive material such as ITO (Indium Tin Oxide) or $SnO_2$ is applied with a thickness of approximately 1400 angstroms in parallel lines on the surface of the front glass substrate 101, which is made of approximately 2.8 mm-thick soda glass.

In addition, precursors of the black electrode films 104 (hereinafter called "precursory black electrode films 104*a*") having ruthenium oxide as a main component, and precursors of the bus electrodes 105 (hereinafter called "precursory bus electrodes 105*a*") composed of Ag, are formed extending along the transparent electrodes 103 and the front glass substrate 101, using a commonly-known technique such as screen printing or photolithography.

Up to this point, the manufacturing method is the same as that for a conventional gas discharge panel.

The front glass substrate 101, on which the precursory black electrode films 104*a* and the precursory bus electrodes 105*a* have been formed, is placed on the setter 200, and is baked with a profile in which a peak temperature is, for example, 590° C. This procedure sinters the precursory black electrodes 104*a* and the precursory bus electrodes 105*a*, thereby forming the black electrode films 104 and the bus electrodes 105.

Note that together with the formed transparent electrodes 103, the black electrode films 104 and the bus electrodes 105 compose the display electrodes 102.

Next, a precursor of the dielectric layer 106 (hereinafter called the "precursory dielectric layer 106*a*") is formed using a commonly-known technique such as screen printing, on the front glass substrate 101 on which the black electrode films 104 and the bus electrodes 105 have been formed. The front glass substrate 101 in this state is placed on the setter 200 and baked.

This procedure sinters the precursory dielectric layer 106*a*, thereby forming the dielectric layer 106.

In addition, the protective layer 107 is formed on the dielectric layer 106 using a commonly-known technique such as sputtering.

As described, the manufacturing method for the gas discharge display panel of the present invention differs to a conventional method in that the front glass substrate 101 and the back glass substrate 111 are baked using the setter 200, which has channels in the surface, instead of the conventional setter 120 that has a flat surface.

The back plate 90 is baked using the setter 200 in the same manner as for the front plate 91.

The following describes the method for manufacturing the back plate 91.

In the method for manufacturing the gas discharge display panel of the present invention, precursors to the address electrodes 112 (hereinafter called "precursory address electrodes 112*a*") are formed on the surface of the back glass substrate 111 by applying conductive material, whose main component is Ag, in stripes which have regular intervals therebetween. The back glass substrate 111, which is made of soda glass that is approximately 2.6 mm thick, is placed on the setter 200 in this state and baked.

This procedure sinters the precursory display electrodes 112*a*, thereby forming the address electrodes 112.

Note that the interval between neighboring address electrodes 112 is set at approximately 0.2 mm or less in order to manufacture the PDP as a 40-inch class high vision television.

Next, the whole surface of the back glass substrate 111 on which the address electrodes 112 have been formed is coated with lead glass paste. The back glass substrate 111 in this state is placed on the setter 200 and baked, thereby forming the dielectric layer 113 which is approximately 20 μm to 30 μm thick.

Furthermore, a paste that is the material of the barrier ribs is applied on the dielectric layer 113 using a dye coating application method. The paste includes lead glass as the main component, and has alumina powder added as an aggregate. Precursors to the barrier ribs 114 (hereinafter called "precursory barrier ribs 114*a*") are formed by removing areas other than those that make up the desired shape with use of sandblasting. The precursory barrier ribs 114*a* are baked, thereby forming the barrier ribs 114 with a height of approximately 100 μm to 150 μm.

At this time the back glass substrate 111 on which the precursory barrier ribs 114*a* have been formed is placed on the setter 200, and the baking performed.

Note that the interval between the barrier ribs 114 is, for example, approximately 0.36 mm.

Next, phosphor ink that includes either red (R), green (G), or blue (B) phosphor is applied to the surface of the barrier ribs 114 and the dielectric layer 113 that is exposed between the barrier ribs 114.

This is dried and baked, thereby forming the phosphor layers 115 of each color.

At this time also, the back glass substrate 111 on which the phosphor ink has been applied is placed on the setter 200 and baked.

Note that the materials used here for the phosphor layers 115 are:

Red phosphor: $(Y_xGd_{1-x})BO_3$:Eu

Green phosphor: $Zn_2SiO_4$:Mn

Blue phosphor: $BaMgAl_{10}O_{17}$:$Eu^{3+}$.

Each type of phosphor material is, for example, powder with an average grain diameter of approximately 3 μm.

The phosphor ink is applied by, for example, discharging the phosphor ink from an extremely fine nozzle.

After the phosphor ink has been applied, the phosphor layers 115 are formed by baking for two hours at a maximum temperature of approximately 520° C.

After the front plate 90 and the back plate 91 are fabricated as described, a commonly-known PDP manufacturing method is used to seal the front plate 90 and the back plate 91 together, evacuate internal impurities, and insert discharge gas. This completes the PDP 100.

The manufacturing method of the gas discharge display panel of the present invention relates the baking processes in manufacturing the front plate 90 and the back plate 91, and therefore a detailed description of the manufacturing process from sealing together of the front plate 90 and the back plate 91 onwards is omitted.

<Setter Specification>

The following describes details of the setter 200 used in the above-described baking processes.

Figure 5:
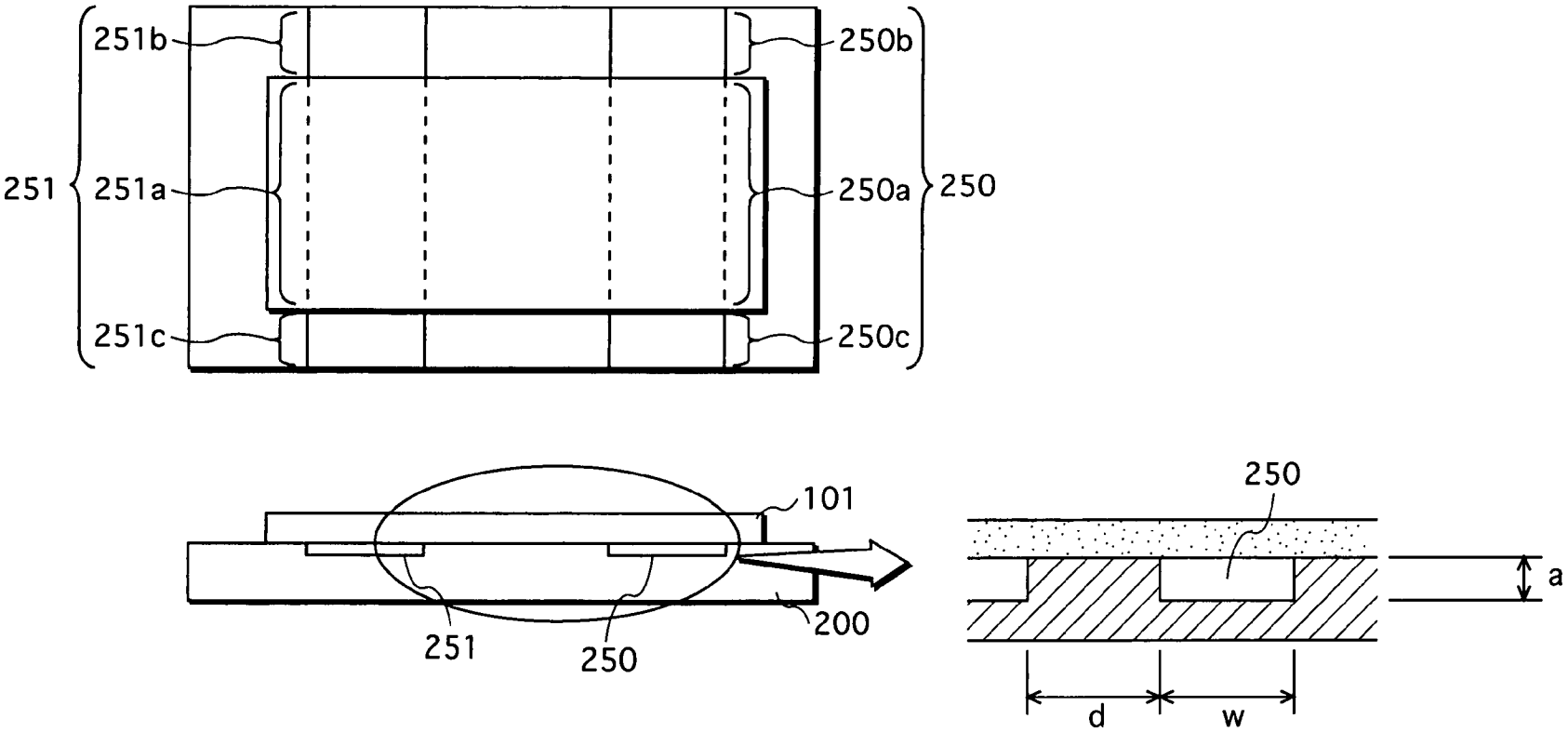
FIG. 5 shows the shape of a setter of an embodiment of the present invention.

FIG. 5 is a schematic diagram of the setter 200 in an embodiment of the present embodiment.

The setter 200 is a platform that supports the back glass substrate 101 and the front glass substrate 111 and is for feeding whichever of the glass substrates is placed thereon into the oven for repeated baking, when baking the precursory dielectric layer 106*a* and the like.

Figure 6:
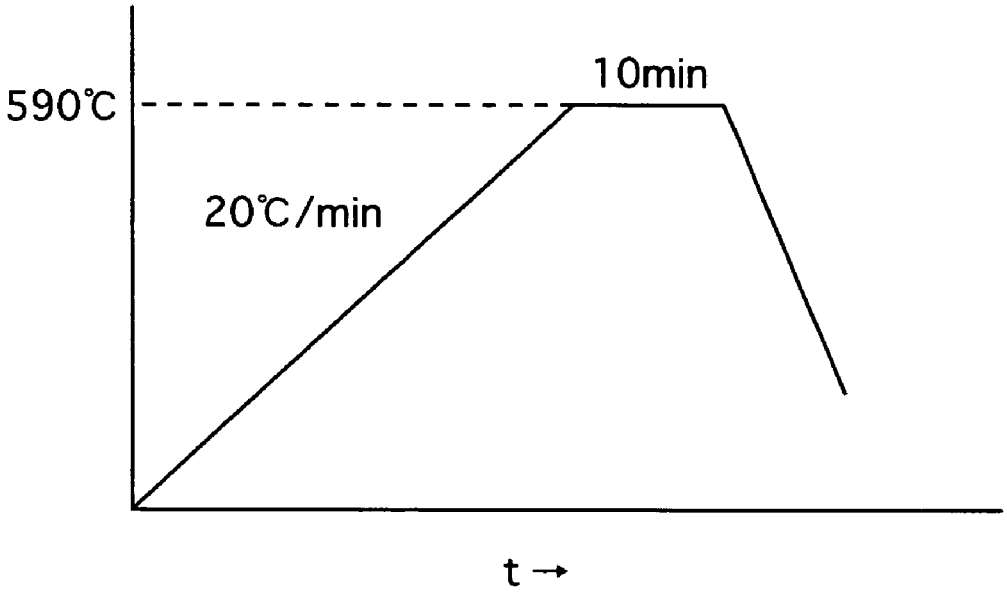
FIG. 6 shows an example of a temperature profile in the baking process.

The setter 200 is used repeatedly in the baking process with a profile such as that shown in FIG. 6 in which the peak temperature is set at 590° C. The setter 200 is made of transparent, heat-resistant glass, such as Neoceram N-0 or N-11 (produced by Nippon Electric Glass), that is resistant to heat fatigue.

The thickness of the setter 200 differs depending on the size of the glass substrates to be placed thereon, but is approximately 5 mm to 8 mm.

The external size of the setter 200 also differs depending on the size of the glass substrates to be placed thereon, but must at least be larger both lengthwise and widthwise than the glass substrates.

Furthermore, as shown in FIG. 5, are plurality of channels, specifically channel 250 and channel 251, are formed in the setter 200. The channels 250 and 251 are vertical with respect to a direction in which the setter 200 carries the glass substrate placed thereon (hereinafter called the "carry direction").

The channel 250 and the channel 251 are identical in shape, and are, for example, 70 mm in width (W), and 2 mm in depth. The distance between the channels (d) is, for example, 400 mm.

The channel 250 and the channel 251 are each formed so as to extend from an area of the setter 200 on which the front glass substrate 101 is placed to outside the area.

For this reason, the channel 250 is divided into a channel portion 250*a* that is covered by the glass substrate, and channel portions 250*b* and 250*c* that are not covered by the substrate, as shown in FIG. 5. Furthermore, the channel 251 is divided into a channel portion 251*a* that is covered by the glass substrate, and channel portions 251*b* and 251*c* that are not covered by the substrate.

Here, the reason for using the setter 200 that is made of heat-resistant glass and has the described channels in the baking process is described.

<Effects of the Surface Shape of the Setter 200>

The surface of the setter, when viewed microscopically, is not specular, but has warps and undulations. Consequently, minute gaps exist between the glass substrate and the setter 120.

Figure 4:
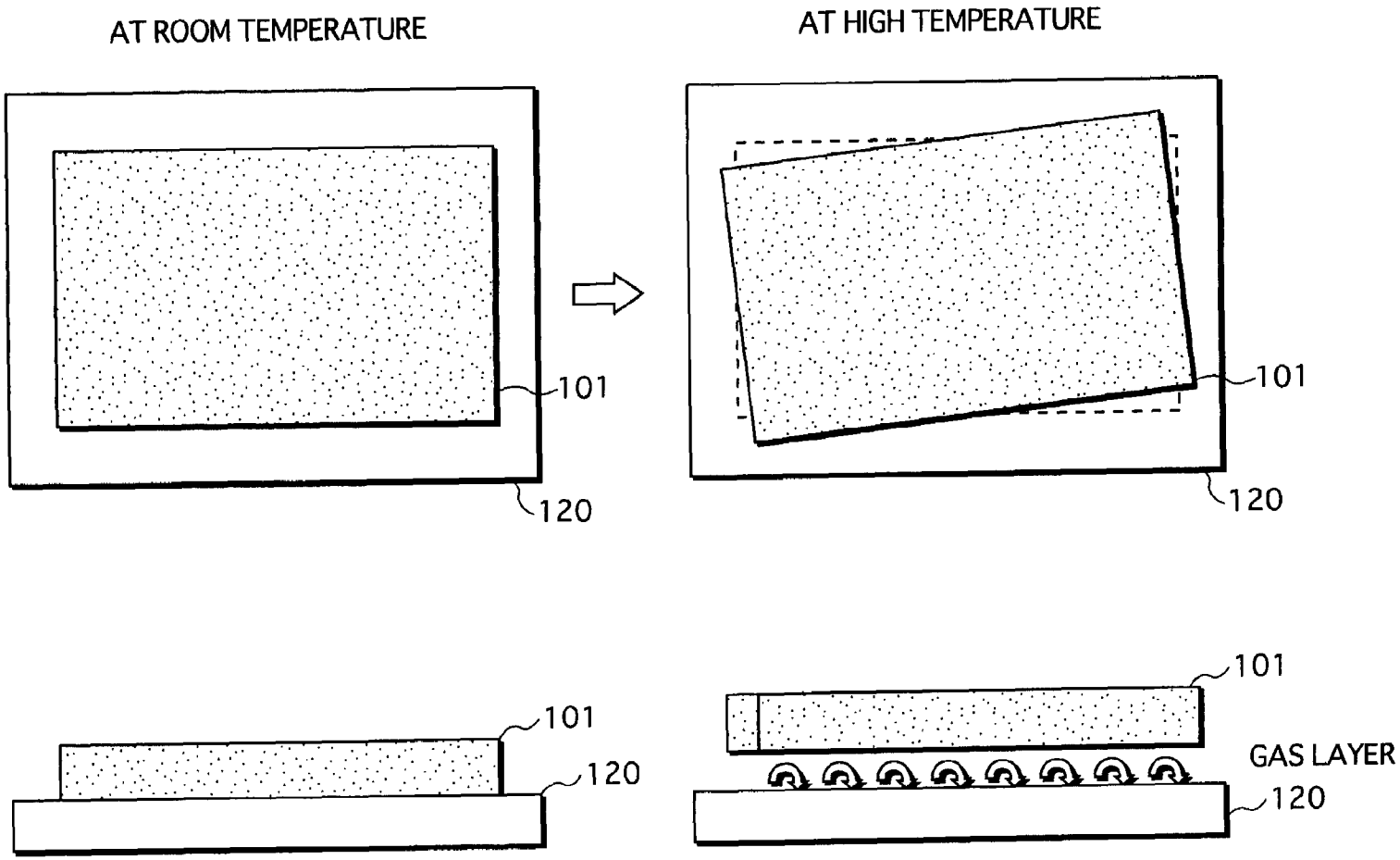
FIG. 4 is for describing movement of the glass substrate on the setter.

A problem occurs that the front glass substrate 101 or the back glass substrate 111 that has been placed in the correct position on the setter 120 at room temperature moves from the correct position during baking. The cause of such misalignment is thought to be convection that occurs in gas that exists in the aforementioned gaps as well as increase in pressure in the gaps as the temperature increases in the baking process. A gas layer such as that shown in FIG. 4 forms between the front glass substrate 101 and the setter 120, and the glass substrate levitates several tens to several hundreds of μm.

The gas convection is thought to be attributable to the difference in temperature between the glass substrate and the setter that comes about because of differences in physical properties, such as heat capacity and thermal conductivity, between the glass substrate and the setter. Furthermore, the gas convection is thought to occur to a greater extent when the glass substrate and the setter are made of different materials.

Figure 7:
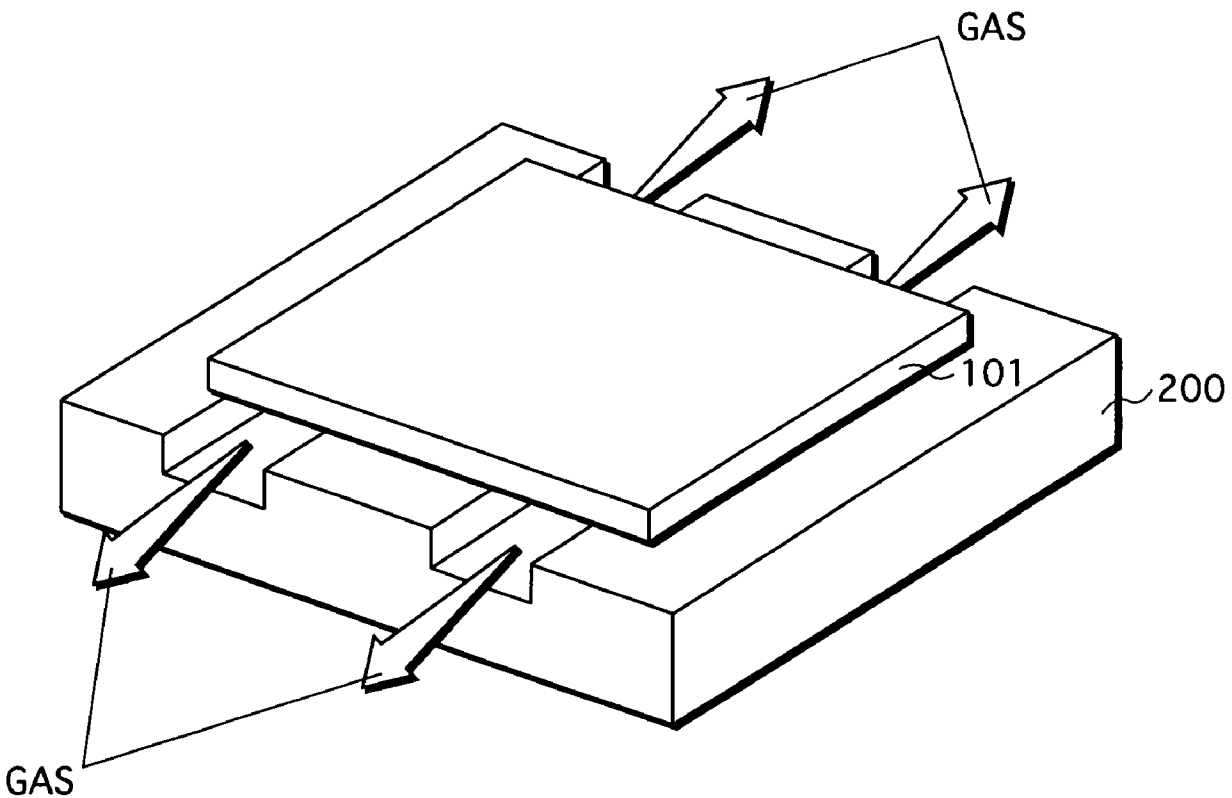
FIG. 7 shows the effect of the shape of the setter.

In the setter 200 of the embodiment of the present invention buoyancy is reduced to an extent that makes it difficult for the glass substrate to float, and therefore difficult for misalignment to occur. The reason for this is that by forming the channel 250 and the channel 251 as described, gas between the front glass substrate 101 and the setter 120 is conveyed to the channel 250 and the channel 251, and discharged from the channel sections 250*b*, 250*c*, 251*b*, and 251*c*, as shown in FIG. 7.

Furthermore, since the channels are provided vertically in relation to the carry direction in the setter 200 of the embodiment of the present invention, when heating of the setter 200 commences from one end thereof in the carry direction, and the end consequently rises in temperature, occurrence of temperature and pressure gradients in the individual channels is suppressed. Therefore, buoyancy is prevented from occurring locally in one channel, and the glass does not easily float.

In addition, since the carry direction of the setter is ordinarily the same as the longitudinal direction of the glass substrate, the channels 250 and 251 are positioned substantially orthogonal to the longitudinal direction of the glass substrate, and the area of the channel sections 250 and 251 that are covered by the glass substrate can be made smaller than would be necessary if they were provided in any other direction.

Accordingly, the volume of gas in the gaps in the range of the channel sections 250*a* and 251*a* is reduced, and the time required to ease pressure increase according to gas emission is reduced. This is advantageous when the carry speed of the setter 200 is fast and the setter 200 is superheated suddenly.

By preventing the above-described misalignment, the materials on the glass substrate that are subject to baking can be baked at an even temperature, and the problem of quality in baking can be improved.

<Effects of the Material of the Setter 200>

Since the setter 200 does not contact the glass substrate directly in the parts where the channels are formed in the surface on which the glass substrate is placed, the surface area of the parts of the glass substrate that do not contact the setter 200, in other words the parts that are in the range of the channel sections 250*a* and 251*a*, is greater than those that contact the setter 120 which has no channels. Therefore, thermal conductivity performance between the setter 200 and the glass substrate is reduced.

Ordinarily, a small difference in temperature between the setter and the glass substrate is desirable, and it is necessary for this difference to be sufficient to ensure thermal conductivity performance. Therefore, when forming channels in a setter that is made from a metal or the like that has a low radiant rate, there is a limit to how big the channels can be made in terms of width and depth.

In contrast, the setter 200 of the present embodiment contributes greatly to thermal conductivity not only because it is made of transparent, heat-resistant glass, but also in terms of the radiant heat. Consequently, the channels can be made wider and deeper than in a metal setter. This means that there is more freedom in designing the setter of the embodiment of the present invention.

In addition, while the glass substrate and the setter are not made of identical material, they are both made of glass material, and therefore exhibit similar physical characteristics in terms of specific heat, thermal tension coefficient, thermal conductivity, and the like. This makes it more difficult for differences in temperature to occur between the glass substrate and the setter, and contributes to suppression of convection.

<Specific Channel Specifications>

Experience shows that the problem of holding irregularities during baking does not occur when the channels are between 5 mm to 200 mm wide, and approximately 2.00 mm deep.

On the other hand, a problem when setting the depth of the channels is whether the depth is sufficient that the gas is able to escape, but that buoyancy is kept to a level at which misalignment does not occur. It is thought that the depth of the channels influences the extent to which warps and undulations occur on the surface of the glass substrate, and experience shows that the channels must be at least 0.05 mm deep to be effective as paths for the gas.

Furthermore, when the channels occupy a relatively small part of the area on which the glass substrate is placed, in other words, when the proportion of the area of the channel sections 250*a* and 251*a* is small, the area of the setter 200 that contacts the glass substrate is relatively large. This can cause sufficient buoyancy for the glass substrate to float according to convection of the gas in the contact areas.

On the other hand, if the proportion of the setter 200 occupied by the channels is too large, the area of contact decreases, and the setter 200 is unable to support the glass substrate properly.

In order to avoid these problems, it is desirable that the channels occupy no less than 10% and no more than 70% of the surface area of the portion of the setter 200 on which the glass substrate is placed.

Note that the contact area denotes the area of the part of the setter 200 on which the glass substrate (here, the front glass substrate 101) is placed, excluding the area occupied by the channel sections 250*a* and 251*a* in FIG. 5.

Furthermore, it is preferable that the channels be formed in positions on the setter 200 throughout the area on which the glass substrate is placed.

In other words, it is preferable that the area for reducing buoyancy according to gas convection is reduced are distributed so that high buoyancy does not occur locally.

For this reason, the channels 250 and 251 are positioned substantially symmetrically relative to a central point of the setter 200.

<Method for Manufacturing the Setter>

The following describes one example of a method for manufacturing the setter 200 used in the baking processes when fabricating the front plate 90 and the back plate 91.

FIGS. 8A to 8E show the manufacturing process for the setter 200.

Figures 8A, 8B, 8C, 8D, 8E:
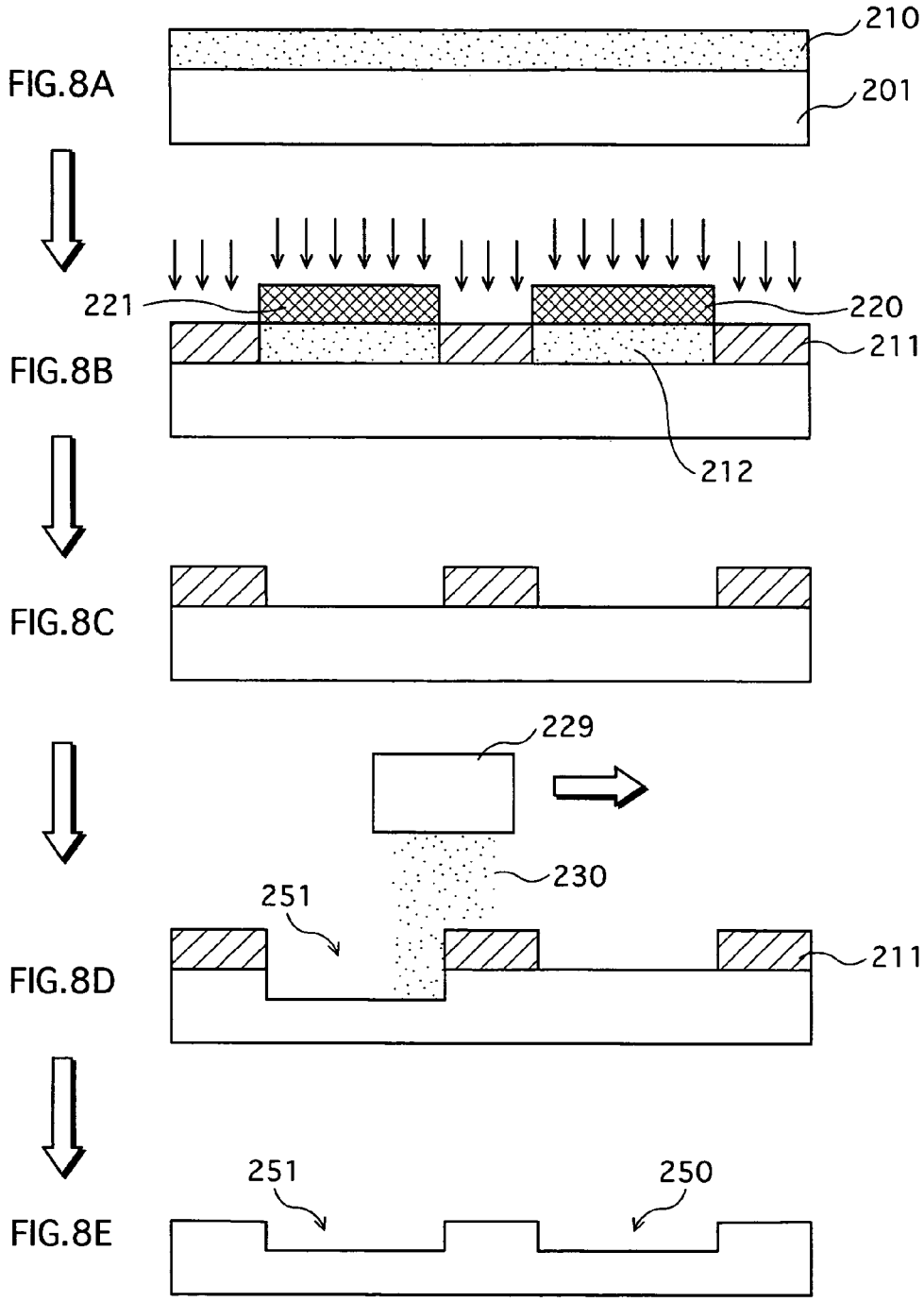
FIG. 8 shows a setter manufacturing process of an embodiment of the present invention.

FIG. 8A shows the first process (photosensitive resist film formation process). In this process, a photosensitive resist film (hereinafter called a "DFR") 210 is laminated on transparent, heat-resistant glass 201. The glass 201 is, for example, a plate that is 1280 mm long, 800 mm wide, and 5 mm thick, and is made of Neoceram N-0 or N11 (produced by Nippon Electric Glass), or the like. The DFR is 50 μm thick, and laminated at a roll temperature of 80° C., a line pressure of 4 kg/cm$^2$, and a sending velocity of 1 m/min.

FIG. 8B shows the second process (exposure and development process). In this process, exposed sections 211 and unexposed sections 212 are formed in order to provide two parallel channels with a width of 70 mm each and a distance therebetween of 400 mm. The exposed sections 211 and the unexposed section 212 are formed using a negative photomask patterned in the described shape, by irradiating ultraviolet light (UV light) using a high pressure mercury lamp with an output of 15 mW/cm$^2$.

Here, the amount of exposure is, for example, 700 mJ.

In addition, development is preformed using, for example, a 1% sodium carbonate developing solution, and the unexposed sections 212 are then removed by washing.

As a result, channels are formed in the DFR 210 in stripes, as shown in FIG. 8C.

FIG. 8D shows the third process (blast process). In this process, after the channels have been formed, sandblasting is performed from the side on which the DFR 210 is formed.

Specifically, a grinding material 230, such as glass beads, is blown from a blast nozzle 229 onto the heat-resistant glass 201 to blast the heat-resistant glass 201, thereby forming the channels. Here, the air current is 1500 NL/min, and the grinding material supply amount is 1500 g/min.

Note that the blasting time is adjusted so that the depressions in the heat-resistant glass 201 are formed with a depth of approximately 2 mm.

FIG. 8E shows the fourth process (photosensitive resist film removal process). In this process, the DFR 210 is removed by immersing the heat-resistant glass 201 in a removal liquid such as 5% sodium hydroxide.

As a result of the described processes, the setter 200 having predetermined channels, specifically, channel 250 and channel 251, is obtained.

In this way, according to the present embodiment, by placing the glass substrate on the setter 200 of the embodiment of the present invention, movement of the glass substrate on the setter, in other words misalignment, can be prevented in the gas discharge display panel baking process.

Note that the width (W) of the channels in the setter 200 in the embodiment of the present invention is not limited to being set at 70 mm. Any other width is possible as long as the area of the channels in the setter is sufficient that the glass substrate does not float.

Furthermore, the setter 200 in the embodiment of the present invention is not limited to having channels of 2 mm in depth and with a distance (d) of 400 mm therebetween. These values may be varied as long as baking defections do not occur in the materials on the glass substrate.

Furthermore, the setter 200 of the embodiment of the present invention is not limited to being made of heat-resistant glass material as described, but may be made of another material such as a material whose main component is a metal, a material whose main component is a metal oxide, or a ceramic.

If a material other than heat-resistant glass is used, it may be necessary to adjust the shape of the channels so that a specified quality in baking can be assured, and so that misalignment does not occur.

Furthermore, although the setter 200 in the present embodiment is described as having two parallel channels in the plate, the number of channels is not limited to two, and may be more than two.

Furthermore, the setter 200 in the present embodiment is not limited to having a plurality of channels provided vertically with respect to the carry direction, but may instead have a plurality of channels provided substantially parallel to the carry direction.

In this case, when heating starts, gas moves from the front part of the setter 200 in the carry direction towards the back part where pressure is low. Therefore, heat is conducted in the longitudinal direction of the channels.

The channels are formed on the setter in a direction such that they have a function of obstructing thermal conductivity between the glass substrate and the setter. However, when the setter is carried at a slow speed, thermal conductivity in the carry direction of the glass substrate and the setter is more important than thermal conductivity between the glass substrate and the setter (between the top and the bottom). Therefore, by providing a plurality of substantially parallel channels in the carry direction over at least the area on the surface of the setter on which the glass substrate is placed, if the setter is heated gradually starting from the front end towards, heat is conducted toward the back end by gas that escapes to the back end. This enables a thermal gradient in the carry direction of the glass substrate and the setter to be suppressed, and further prevents unevenness of temperature distribution.

Figure 9:
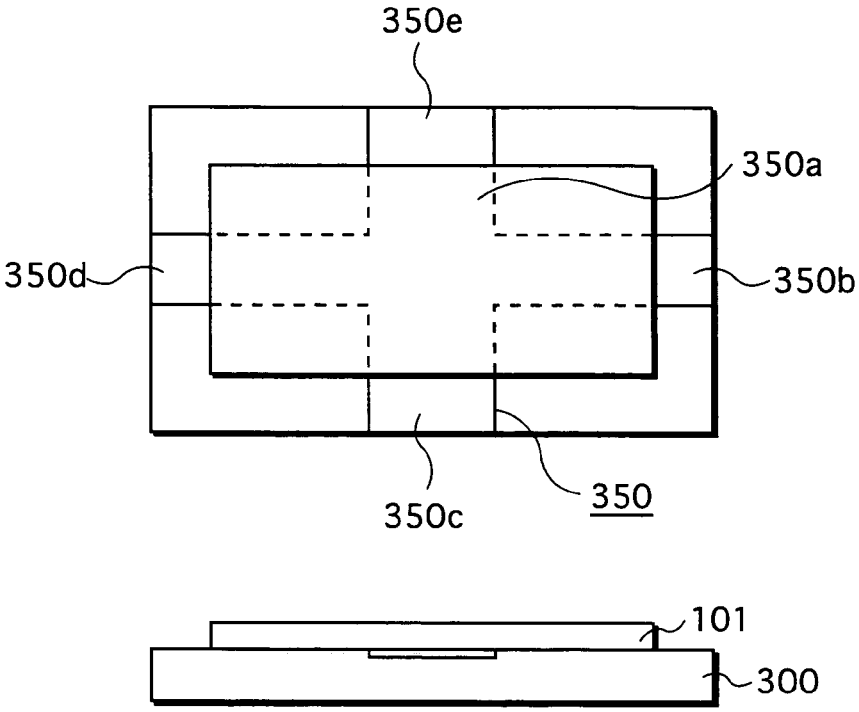
FIG. 9 shows a variation of the setter shape of an embodiment of the present invention.

Furthermore, although the setter 200 in the present embodiment is described as having two parallel channels in the plate, the channels are not limited to this shape. It is sufficient for the channels to allow gas between the setter and the glass substrate to escape. A setter 300 having a cross-shape channel 350 shown in FIG. 9 is one example.

In this case, when the glass substrate is placed on the setter 300, the channel 350 has a channel section 350*a* that is covered by the glass substrate, and channel sections 350*b*, 350*c*, 350*d*, and 350*e* that are not covered by the glass substrate.

Figure 10:
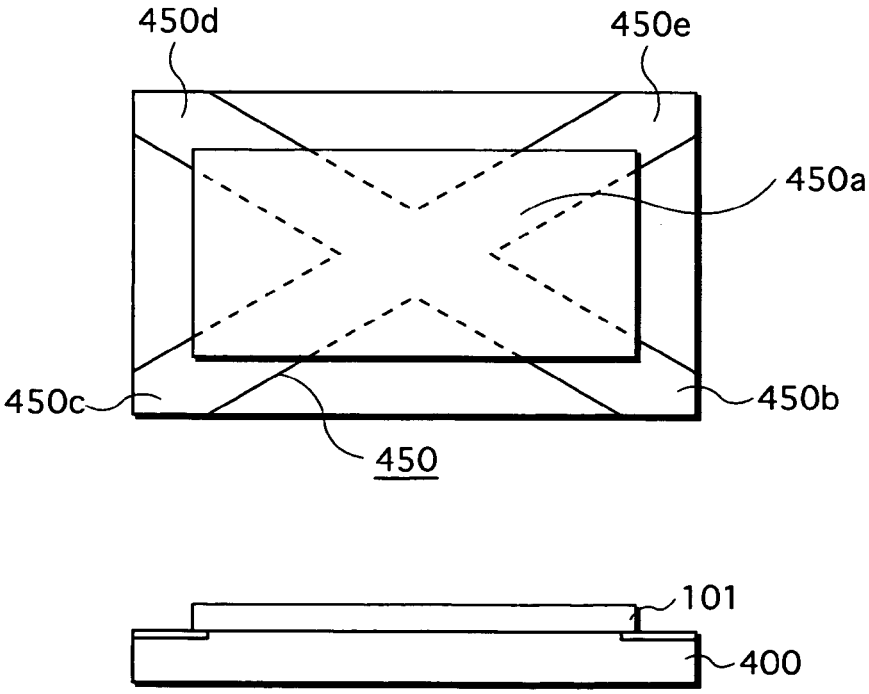
FIG. 10 shows a variation of the setter shape of an embodiment of the present invention.

Furthermore, another variation is a setter 400 having a channel 450, as shown in FIG. 10, provided on diagonal axes of the setter.

In this case, when the glass substrate is placed on the setter 400, the channel 450 has a channel section 450*a* that is covered by the glass substrate, and channel sections 450*b*, 450*c*, 450*d*, and 450*e* that are not covered by the glass substrate.

Figure 11:
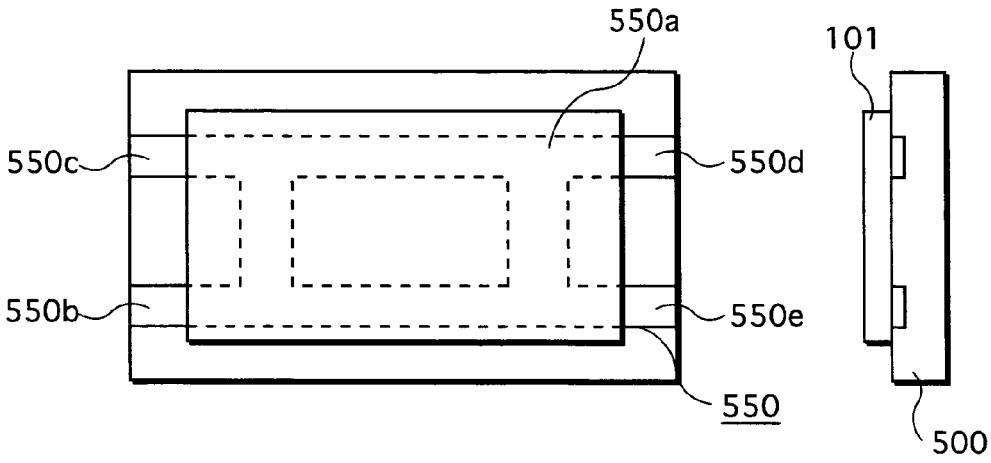
FIG. 11 shows a variation of the setter shape of an embodiment of the present invention.

A setter 500 having a channel 550 in a lattice formation, as shown in FIG. 11, is possible.

In this case, when the glass substrate is placed on the setter 500, the channel 550 has a channel section 550*a* that is covered by the glass substrate, and channel section 550*b*, 550*c*, 550*d*, and 550*e* that are not covered by the glass substrate.

Figure 12:
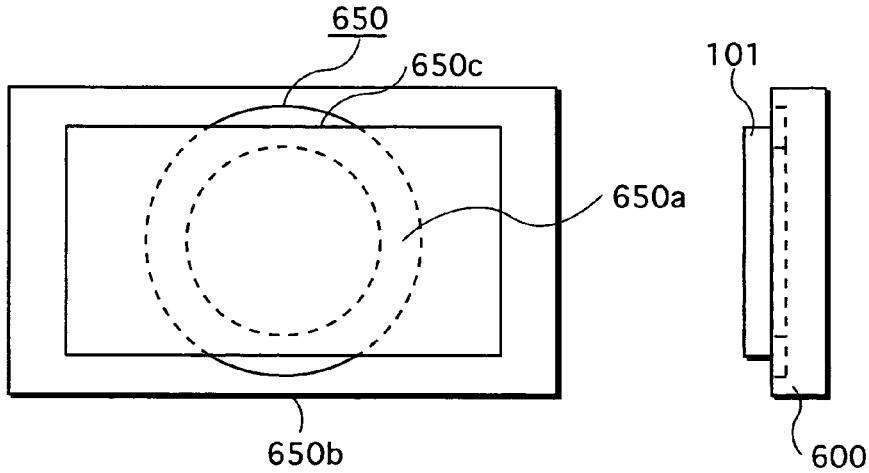
FIG. 12 shows a variation of the setter shape of an embodiment of the present invention.

Furthermore, another variation is a setter 600 having a channel 650, as shown in FIG. 12.

In this case, when the glass substrate is placed on the setter 600, the channel 650 has a channel section 650*a* that is covered by the glass substrate, and channel sections 650*b*, and 650*c* that are not covered by the glass substrate.

Figure 13:
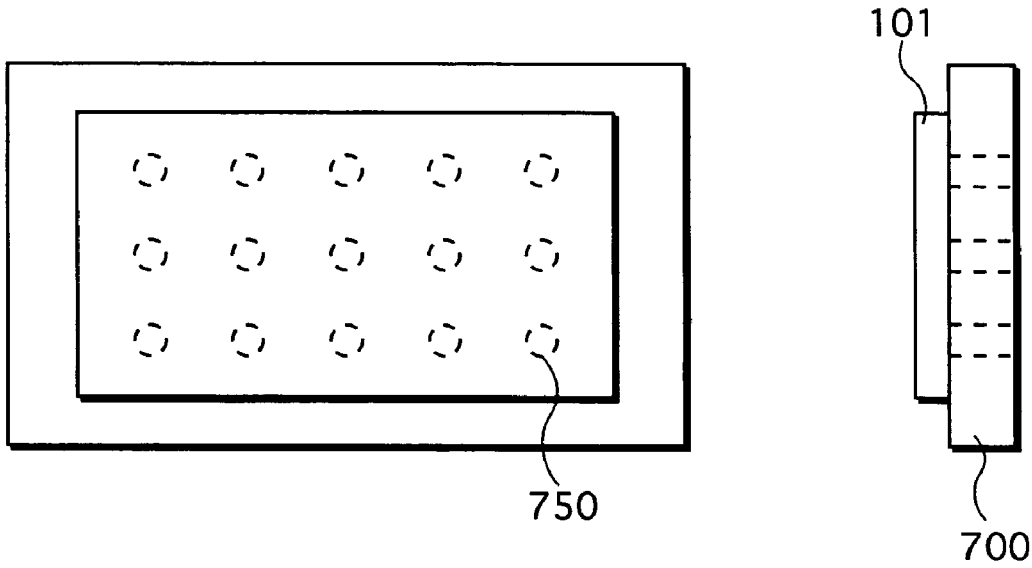
FIG. 13 shows a variation of the setter shape of an embodiment of the present invention.

Furthermore, although the channels are provided on the surface of the setter 200 of the present embodiment on which the glass substrate is placed (hereinafter referred to as the "placement surface"), instead of providing channels on the surface, it is possible to provide a plurality of holes 750 that extent from the placement surface through to the back surface, as in a setter 700 shown in FIG. 13.

In this case it is essential to provide sufficient holes for the gas to escape so that even if some of the lower surface side is blocked by the hearth rollers 130 or the like, the remaining holes prevent the glass substrate from floating.

Furthermore, the channels in the setter 200 of the present invention are not limited to being formed by sandblasting as described in the present embodiment. Other possible methods include chemical etching by dissolving the glass surface using hydrogen fluoride oxyhydrogen solution, and laminating protruding parts onto the surface of the glass areas other than where the channels are to be positioned, using a method such as thermal spraying.

INDUSTRIAL APPLICABILITY

The present invention can be applied to manufacturing of a gas discharge display panel such as a plasma display panel used as a television, a computer monitor, or the like.

What is claimed is:

1. A manufacturing method for a gas discharge display panel, comprising:

a disposing step of disposing on a substrate, material of one of an electrode, a dielectric layer, a barrier rib, and a phosphor layer; and a baking step of baking the substrate on which the material has been disposed, while the substrate is carried on a support platform, wherein the support platform has at least one channel in a surface thereof on which the substrate is placed, extending from a covered area covered by the substrate through to an exposed area not covered by the substrate.

2. The manufacturing method for a gas discharge display panel of claim 1, wherein a plurality of the channels are provided in the surface, distributed throughout the covered area.

3. The manufacturing method for a gas discharge display panel of claim 2, wherein a continuous baking oven is used for the baking, and the plurality of channels are positioned substantially perpendicular to a direction in which the substrate is carried into the baking oven.

4. The manufacturing method for a gas discharge display panel of claim 2, wherein a continuous baking oven is used for the baking, and the plurality of channels are positioned substantially parallel to a direction in which the substrate is carried into the baking oven.

5. The manufacturing method for a gas discharge display panel of claim 2, wherein the plurality of channels are positioned substantially symmetrically relative to a center point or a center line of the covered area.

6. The manufacturing method for a gas discharge display panel of claim 2, wherein a non-contact area, which is a part of the covered area and is where the substrate and the support platform do not contact each other, has a surface area that is equal to at least 10% and no more than 70% of a surface area of the substrate.

7. The manufacturing method for a gas discharge display panel of claim 1, wherein the support platform is made of a material whose main component is glass.

8. The manufacturing method for a gas discharge display panel of claim 7, wherein each channel is at least 0.05 mm and no more than 2.0 mm deep, and at least 5 mm and no more than 200 mm wide.

9. A manufacturing method for a gas discharge display panel, comprising:

a disposing step of disposing on a substrate, material of one of an electrode, a dielectric layer, a barrier rib, and a phosphor layer; and a baking step of baking the substrate on which the material has been disposed, while the substrate is carried on a support platform, wherein the support platform has a plurality of holes extending from a top surface on which the substrate is placed through to a bottom surface.

10. A support platform for carrying a substrate in a process for baking material disposed on the substrate, the substrate being used in a gas discharge display panel, wherein at least one channel is provided in a surface of the support platform on which the substrate is carried, each channel extending from a covered area covered by the substrate through to an exposed area not covered by the substrate.

11. The support platform of claim 10, wherein a plurality of the channels are provided in the surface, distributed throughout the covered area.

12. The support platform of claim 11, wherein a continuous baking oven is used for the baking, and the plurality of channels are positioned substantially perpendicular to a direction in which the substrate is carried into the baking oven.

13. The support platform of claim 11, wherein a continuous baking oven is used for the baking, and the plurality of channels are positioned substantially parallel to a direction in which the substrate is carried into the baking oven.

14. The support platform of claim 11, wherein the plurality of channels are positioned substantially symmetrically relative to a center point or a center line of the covered area.

15. The support platform of claim 11, wherein a non-contact area, which is a part of the covered area and is where the substrate and the support platform do not contact each other, has a surface area that is equal to at least 10% and no more than 70% of a surface area of the substrate.

16. The support platform of claim 10, wherein the support platform is made of a material whose main component is glass.

17. The support platform of claim 16, each channel is at least 0.05 mm and no more than 2.0 mm deep, and at least 5 mm and no more than 200 mm wide.

18. A support platform for carrying a substrate in a process for baking material disposed on the substrate, the substrate being used in a gas discharge display panel, wherein the support platform has a plurality of holes extending from a top surface on which the substrate is placed through to a bottom surface.

19. A manufacturing method for a support platform for carrying a substrate in a process for baking material disposed on the substrate, the substrate being used in a gas discharge display panel, the manufacturing method including:

a channel forming step of forming at least one channel in a surface of plate that is used in the support platform, the channel extending from a covered area that is covered by the substrate when the substrate is placed on the support platform, through to an exposed area that is not covered by the substrate when the substrate is placed on the support platform.

20. The manufacturing method for a support platform of claim 19, a non-contact area, which is a part of the covered area and is where the substrate and the support platform do not contact each other, has a surface area that is equal to at least 10% and no more than 70% of a surface area of the substrate.

21. The manufacturing method for a support platform of claim 20, wherein in the channel forming step, the channel is formed by removing part of the surface by sandblasting.

22. The manufacturing method for a support platform of claim 20, wherein in the channel forming step, the channel is formed dissolving part of the surface by chemical etching.

23. The manufacturing method for a support platform of claim 20, wherein in the channel forming step, the channel is formed by providing protrusions on the surface excluding an areas where the channel is to be provided, using thermal spraying.

24. A manufacturing method for a support platform for carrying a substrate in a process for baking material disposed on the substrate, the substrate being part of a gas discharge display panel, the manufacturing method including:

a hole forming step of forming a plurality of holes in a plate that is part of the support platform, the holes extending from a top surface of the plate that is covered by the substrate when the substrate is placed on the plate, through to a bottom surface.

25. The manufacturing method for a gas discharge display panel of claim 2, wherein the support platform is made of a material whose main component is glass.

26. The manufacturing method for a gas discharge display panel of claim 3, wherein the support platform is made of a material whose main component is glass.

27. The manufacturing method for a gas discharge display panel of claim 4, wherein the support platform is made of a material whose main component is glass.

28. The manufacturing method for a gas discharge display panel of claim 5, wherein the support platform is made of a material whose main component is glass.

29. The manufacturing method for a gas discharge display panel of claim 6, wherein the support platform is made of a material whose main component is glass.

30. The support platform of claim 11, wherein the support platform is made of a material whose main component is glass.

31. The support platform of claim 12, wherein the support platform is made of a material whose main component is glass.

32. The support platform of claim 13, wherein the support platform is made of a material whose main component is glass.

33. The support platform of claim 14, wherein the support platform is made of a material whose main component is glass.

34. The support platform of claim 15, wherein the support platform is made of a material whose main component is glass.

* * * * *

UNITED STATES PATENT AND TRADEMARK OFFICE

CERTIFICATE OF CORRECTION

PATENT NO. : 7,063,584 B2
APPLICATION NO. : 10/478890
DATED : June 20, 2006
INVENTOR(S) : Hiroyuki Yonehara et al.

It is certified that error appears in the above-identified patent and that said Letters Patent is hereby corrected as shown below:

On the Title page: should read;

(75) Inventors: Hiroyuki Yonehara, Hirakata (JP); Masaki Aoki, Minoo (JP); Keisuke Sumida, Hirakata (JP); Morio Fujitani, Takatsuki (JP); Hideki Asida, Settsu (JP); Sadao Uemura, Osaka (JP)

Signed and Sealed this

Fourteenth Day of April, 2009

John Doll

JOHN DOLL
*Acting Director of the United States Patent and Trademark Office*